US006976651B2

(12) United States Patent
Jamison et al.

(10) Patent No.: US 6,976,651 B2
(45) Date of Patent: Dec. 20, 2005

(54) TISSUE REEL TRANSFER DEVICE AND METHOD

(75) Inventors: Chris Mark Jamison, West Chester, OH (US); Christian Viviers, St. Constant (CA); Jerry William Tillery, Hamilton, OH (US); Richard Phillip Weigand, Plainsboro, NJ (US)

(73) Assignee: Valco Cincinnati, Inc., Cincinnati, OH (US)

( * ) Notice: Subject to any disclaimer, the term of this patent is extended or adjusted under 35 U.S.C. 154(b) by 0 days.

(21) Appl. No.: 10/284,276

(22) Filed: Oct. 30, 2002

(65) Prior Publication Data

US 2003/0160128 A1 Aug. 28, 2003

Related U.S. Application Data

(60) Provisional application No. 60/340,830, filed on Oct. 30, 2001.

(51) Int. Cl.[7] ..... B65H 19/28
(52) U.S. Cl. ..... 242/532.3
(58) Field of Search ..... 242/532.3; 156/184, 156/191, 192

(56) References Cited

U.S. PATENT DOCUMENTS 3,951,890 A * 4/1976 Reilly et al. ..... 524/30
5,238,535 A 8/1993 Kraft
5,730,387 A 3/1998 Yamazaki
5,738,760 A 4/1998 Svanqvist et al.
5,782,426 A * 7/1998 Kinnunen et al. ..... 242/532.3
6,045,085 A * 4/2000 Andersson et al. ..... 242/532.3
6,073,824 A 6/2000 Gray et al.
6,253,818 B1 7/2001 Preinknoll
6,358,586 B1 * 3/2002 Fujita et al. ..... 428/36.9
6,467,719 B1 * 10/2002 Rodriguez ..... 242/532.3
6,705,560 B1 * 3/2004 Rågård et al. ..... 242/521

* cited by examiner

*Primary Examiner*—John Q. Nguyen
(74) *Attorney, Agent, or Firm*—Dinsmore & Shohl LLP

(57) ABSTRACT

The present invention relates to a system and method for transferring tissue reels. The system preferably incorporates nozzles that spray an adhesive directly onto moving tissue paper substrate, as opposed to applying adhesive directly to the reel, independent of machine speeds and basis weights of the substrate. Alternatively, the system of the present invention may also apply adhesive directly to the new reel as opposed to the tissue paper substrate. In the preferred embodiment, the new core or reel is brought up to substantially equivalent speed as the moving tissue paper substrate and placed into contact with the moving web of tissue. When the new reel is in place, the valves are activated thereby spraying adhesive across the width of moving tissue. The newly coated substrate sticks substantially immediately to the new core and cleanly tears away from the completed roll.

7 Claims, 5 Drawing Sheets

TISSUE REEL TRANSFER DEVICE AND METHOD

RELATED APPLICATIONS

This application claims the priority of Provisional Patent Application Ser. No. 60/340,830 filed on Oct. 30, 2001 and entitled "Tissue Tack and Reel Transfer System."

BACKGROUND OF THE INVENTION

1. Technical Field

The present invention relates generally to paper accumulating machines and, more particularly, to a method and system for transferring tissue paper from one tissue-accumulating reel to another.

2. Description of Related Art

In the tissue paper and paper towel producing industry, conventional paper machines produce a paper web of a given width that is wound around a reel as it is being produced. As each reel becomes filled to capacity, an empty reel replaces it. To effect this reel transfer, the web of tissue being produced (or being transferred from one reel to another) must be detached from the full reel and reattached to another empty reel. In the manufacturing of lightweight tissue and paper products, a significant amount of lost production is seen in the transfer of one roll of finished product to the next. The difficulty arises when one roll is completed and the next roll is started. Current methods used to transfer from the completed roll to the newly introduced reel (also referred to as core or spool) are not efficient. Some methods start a new roll at full machine speed with an inefficient method of tacking a slim "tail" strip of the tissue to the new core. This is often done by altering the core itself or applying a fluid onto the core to pick up the leading edge of the tissue. These inefficient methods often either deface a large portion of tissue on the beginning of the reel or tear the tissue which requires production to be down for manual rethreading of the leading edge of the tissue onto the reel. Other methods require slowing or stopping the paper machine for manual or semi-automatic tissue transfer onto the new core. These methods require the placement of one or more operators in locations that significantly increase the risk of injury. All of the methods commonly used are inefficient and therefore waste and lost time in production occurs because of poor reel transfer.

BRIEF SUMMARY OF THE INVENTION

In contrast to prior art tissue paper reel transfer systems, the present invention incorporates a reliable and fully automated system, which significantly eliminates lost production and waste associated with poor reel transfer. This system preferably incorporates one or more nozzles that spray an adhesive directly onto moving tissue paper substrate, as opposed to altering or applying adhesive directly to the reel, independent of machine speeds and basis weights of the substrate. Alternatively, the system of the present invention may also apply adhesive directly to the new reel as opposed to the tissue paper substrate. In the preferred embodiment, after the new core or reel is brought up to substantially equivalent speed and into contact with the moving tissue paper substrate, adhesive is applied to the substrate. The new reel, which is rotating and which is in contact with the substrate, comes into contact with the segment of tissue having been sprayed with adhesive. When this contact occurs, the newly coated substrate sticks substantially immediately to the new core and cleanly tears away from the completed roll. Because adhesion occurs across around at least a part of the circumference and across a segment substantially as wide as the reel, the tendency of side motion and uneven forces, which causes poorly wound spools and torn substrate, is significantly reduced. As a result, minimal downtime between reel changes occurs and production rates are maintained.

Additional advantages of the present invention realized over prior art transfer systems is the substantial elimination of human operator intervention to effect reel transfer. Unlike prior art manual transfer systems that use a transfer tail of substrate that result in uneven diagonal tearing or cutting of the substrate, the present invention minimizes wasted substrate by allowing for rapid transfer across the entire width of the web. This configuration, unlike prior art transfer methods, allows reels to be unwound to the core with minimal wasted unusable tissue adjacent the reel. Because adhesive is used across the width of the web, web breakage and associated lost production is kept to a minimum with the present system and method. According to the present invention, different amounts of adhesive may be applied to the substrate depending on production conditions such as different paper basis weights or tissue web speeds.

BRIEF DESCRIPTION OF THE DRAWINGS

The present preferred embodiments of the invention will be described with reference to the included drawings wherein like numerals represent like structures and wherein.

DETAILED DESCRIPTION OF THE INVENTION

Figure 1:
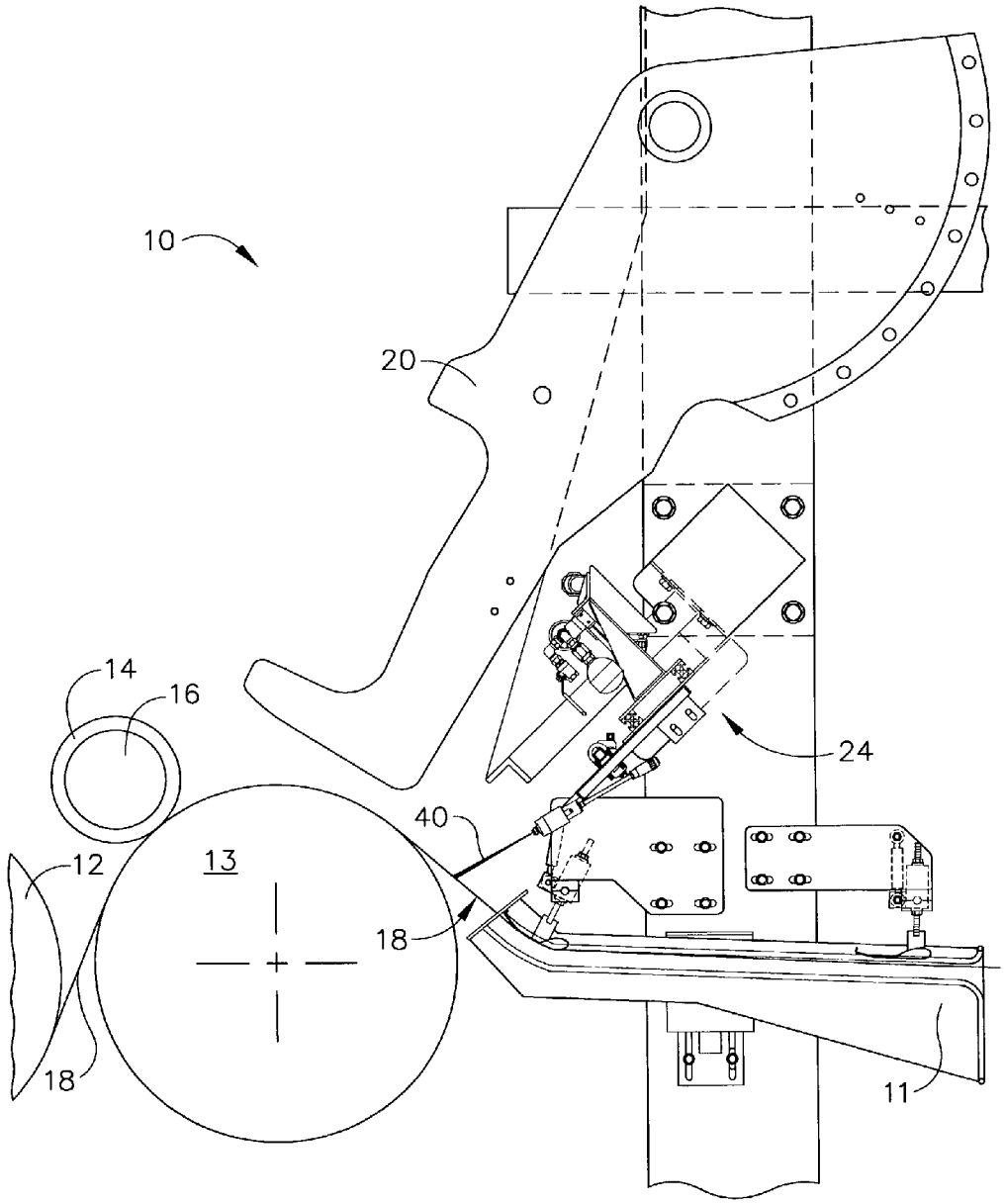
FIG. 1 shows the tissue transfer device of the present invention in place on a winding unit of a paper machine.

As best shown in FIG. 1, a paper machine winding device 10 is shown depicted on a typical prior art tissue paper machine in which the tissue paper is fed through threading tube 11 into contact about reel drum 13. As can be seen in FIG. 1, an empty spool reel 14 includes a core shaft 16 capable of being moved by a lever 20 from a storage area holding multiple empty reels 14 and into position substantially adjacent a carrier drum conveying tissue paper 18. As shown in FIG. 1, an empty reel spool 14 is typically rotated towards the full reel of tissue 12 and into contact with the moving web of tissue 18 at which time the moving tissue is detached substantially across its entire width and continues winding onto the empty reel spool 14 while the full reel 12 is moved away thus completing the transfer process.

As shown in FIG. 1, and according to the present invention, an adhesive supply device, generally shown at 24, is fixably attached to the frame work of the winding device 10 in proximity with the web of moving tissue, and as will be described in detail below, is selectively activated in order to improve the efficiency of the reel transfer process so as to minimize downtime and waste material associated with prior art transfer methods and devices. Although the mounting position of the adhesive supply device of the present invention is shown as being mounted in proximity with the moving web of tissue at a position above the tissue as it emerges from the threading tube 11, it should be appreciated that the exact position of the adhesive supply device on the paper winding machine is not critical and the placement of the invention shown in the Figures should be regarded as illustrative in nature and not as restrictive.

Figure 2:
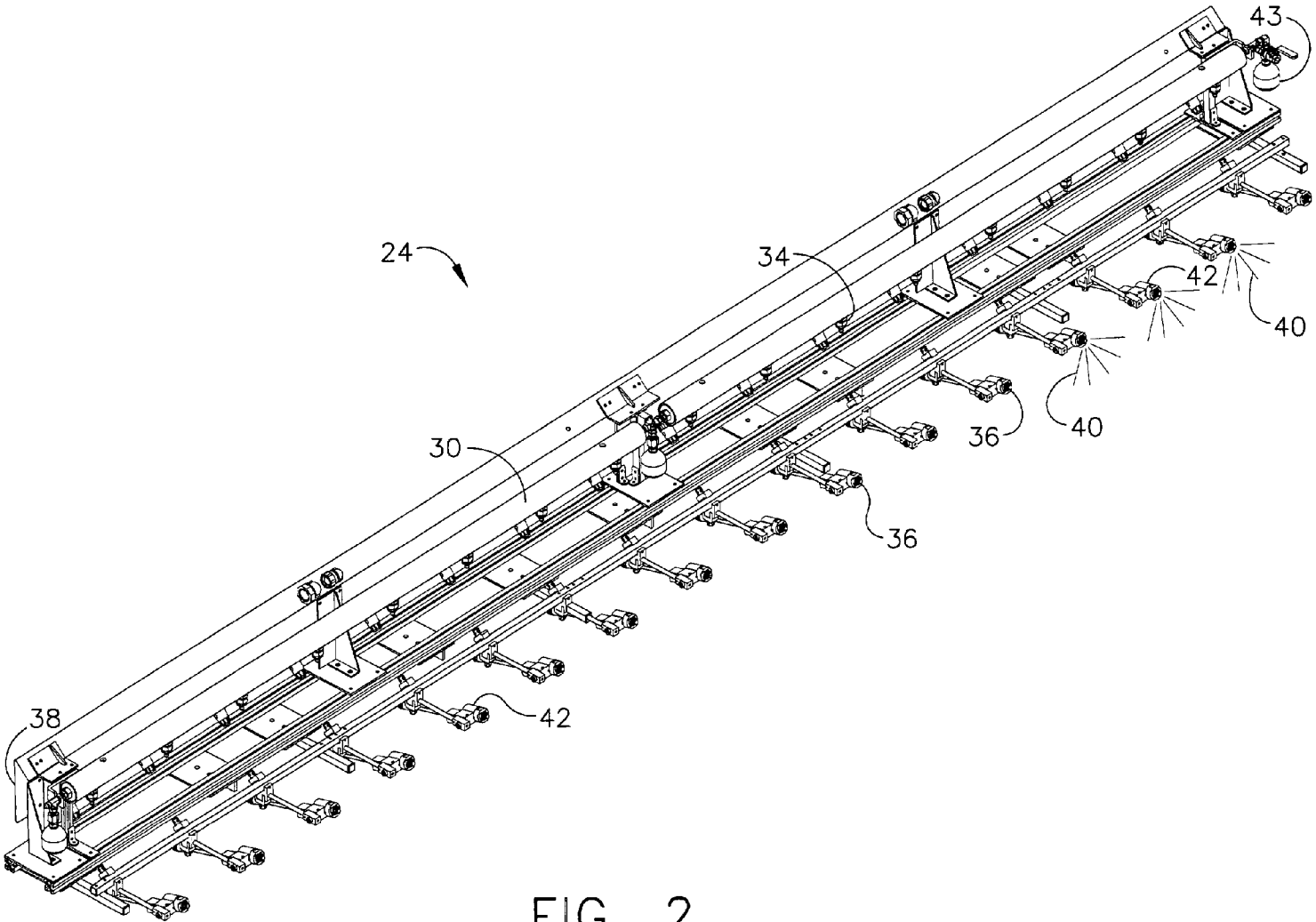
FIG. 2 is a perspective view of the tissue transfer device of the present invention.
Figure 3:
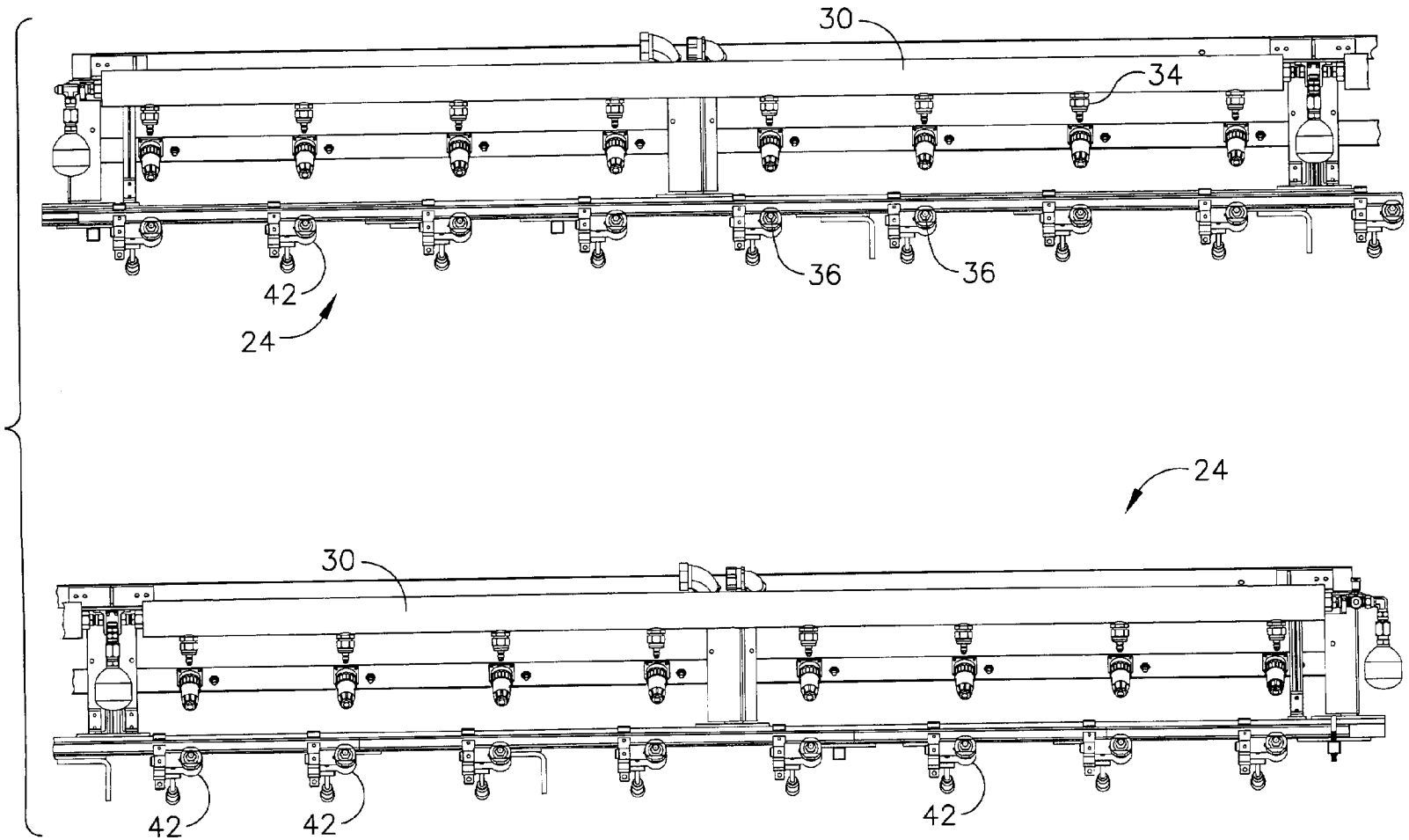
FIG. 3 is a front elevation view of the tissue transfer device of the present invention.

As shown in FIGS. 2 and 3, the adhesive supply device 24 of the present invention generally comprises a manifold system 30. The manifold 30 of the adhesive supply device 24 is disposed substantially across the width of the moving web of tissue 18 on the winding device 10. In order to maximize coverage area across the width of tissue to be sprayed with adhesive, a number of valves 42 are disposed, preferably in substantially spaced apart fashion, across the manifold 30. Preferably, the valves are electronically controlled in order to achieve the desired precise and relatively short activation or "on" time. Valves 42 could also be pneumatic valves or mechanical valves. They are preferably electronic due to the very high speed of the tissue web being passed below and because the valves need to be activated only for fractions of a second. Preferably, the valves are only activated during operation for a time period in range of about 1 mS to about 2 seconds. More preferably, the valves are activated in a range of about 100 mS to about 500 mS. Preferably, the valves are substantially waterproof to facilitate machine cleaning that normally uses high pressure water.

Figure 4:
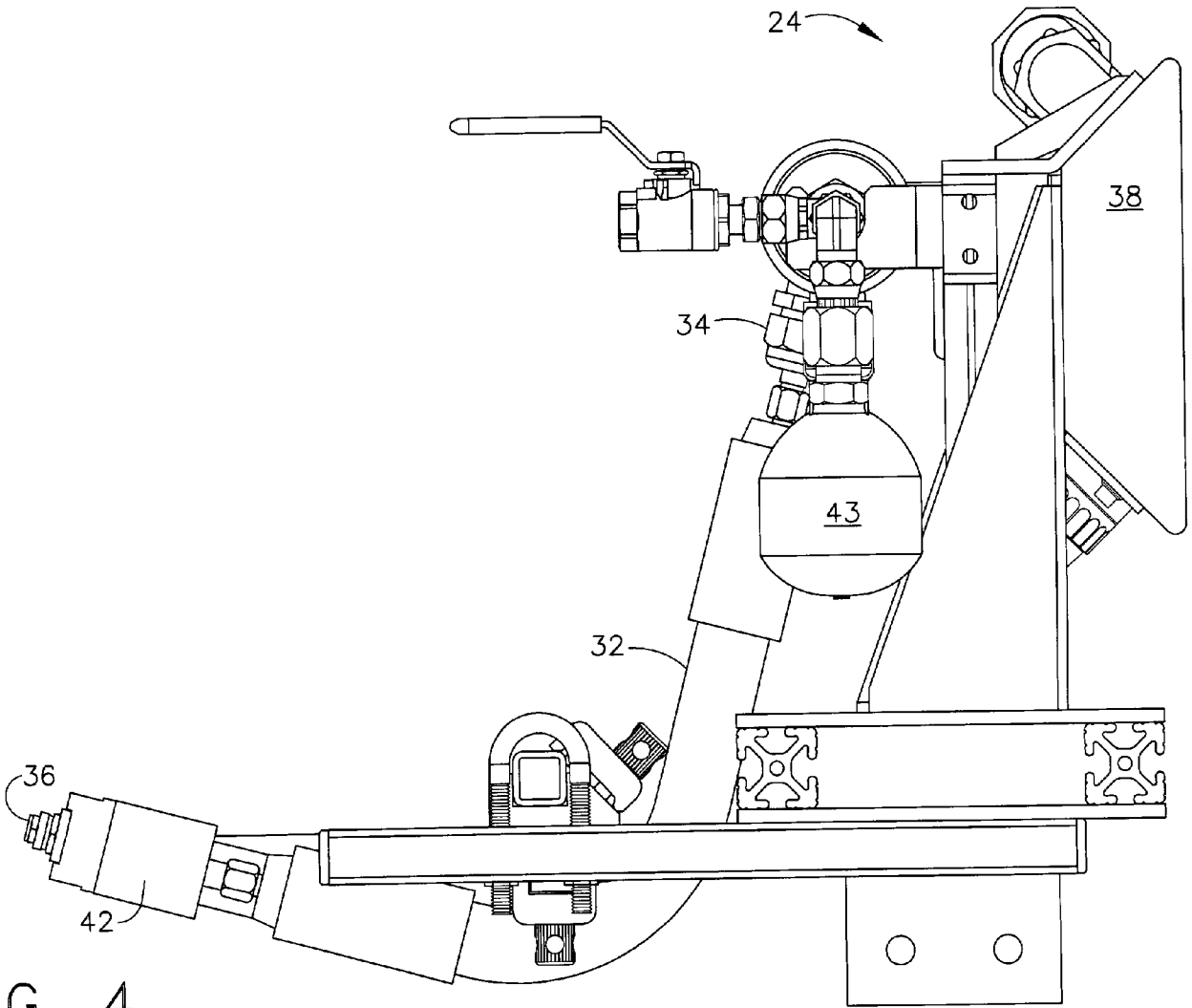
FIG. 4 is a side elevation view of the tissue transfer device of the present invention.
Figure 5:
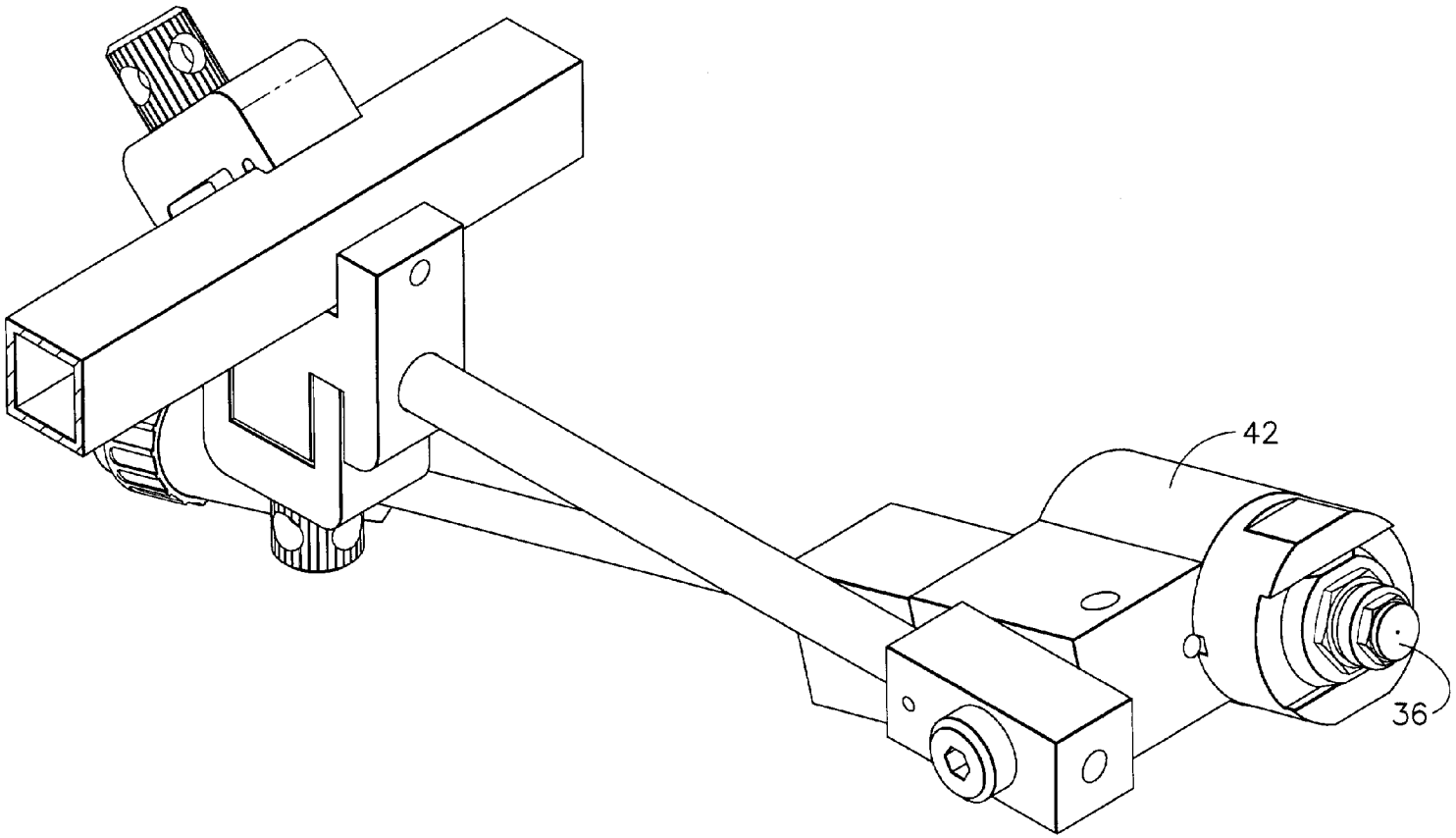
FIG. 5 is a perspective view of the tissue transfer nozzle, valve and valve bracket.

The manifold 30 may be heated by wrapping resistance wire and installation about the manifold. Preferably, the manifold is comprised of a stainless steel elongated tube having a number of spaced apertures 34 that are in communication with corresponding valves 42. As best shown in FIG. 4, a number of feeder conduits 32 may link the manifold apertures 34 with the valve assemblies 42. Alternatively, the valve assemblies may be mounted directly to the manifold. Preferably, the temperature of the manifold is controlled by any typical means known in the art. Preferably, the adhesive supply device 24 of the present invention includes first and second heated manifolds 30 that are fed adhesive from a pressurized adhesive source. Accumulators 43 are preferably mounted on either sides of the manifold to reduce undesirable pressure drop from the source of pressurized adhesive and the manifold so that adhesive may be supplied through the valves at a substantially consistent pressure. Accumulators 43 could also be mounted at one or more locations along the length of manifolds 30.

The feeder conduits 32 are preferably adapted to convey adhesive from the heated manifold 30 and into the associated valves 42. These feeder conduits 32 are preferably heated in order to maintain desired viscosity of the adhesive being carried there through. Feeder conduits 32 may comprise feeder hoses, as shown in the figures, or may comprise couplings, which may mount the valve assemblies directly onto the manifold. The temperature of the feeder conduits may be either individually controlled or slaved together and controlled as a group. Preferably, the temperature of both the feeder conduits 32 and the manifold system are controlled from the source of pressurized adhesive (not shown).

As shown in the figures, a junction box assembly 38 may be provided to the adhesive supply device 24 of the present invention in order to provide electrical connection for the heating devices and valve wiring to be collected and sent via a liquid tight conduit back to the source of pressurized adhesive. In order to provide for ease of cleaning, the junction box is preferably substantially waterproof. Although it is preferred that the system have various components heated in order to control viscosity, it should be appreciated that depending on the viscosity of the adhesive being used, that an adhesive supply device 24 may be used without the heating system.

As shown in the figures, the valves 42 are in communication with corresponding spray nozzles 36 configured such that preferably a fan pattern of adhesive dispensed there through is achieved. Preferably, the nozzles 36 are "atomizing or airless" nozzles. Alternatively, the nozzles may be air spray nozzles. As shown in FIG. 2, the fan shape 40 that the adhesive is preferably dispensed in maximizes coverage across the width of the tissue web. Preferably, the nozzles administer or dispense adhesive at an inclusive fan angle of between about 90 degrees and 110 degrees. Adhesive is supplied by the valves to the nozzles preferably at a pressure in a range of about 1000 psi to about 2500 psi. As seen in FIGS. 1 and 4, preferably the adhesive supply device is positioned above and slightly behind the carrier drum 13 above the moving web of tissue 18. As can be seen best in FIG. 4, the valve and nozzles dispensing adhesive are preferably disposed substantially normal to the web of moving tissue 18.

In order to effect the transfer of moving tissue from a full reel 12 to an empty reel 14, and as described briefly before, it is necessary to first provide a source of pressurized adhesive. The source of pressurized adhesive may include a typical adhesive-melting unit powered by a transfer pump. The source of pressurized adhesive is preferably disposed away from the paper machine in order to provide for ease of interaction and maintenance. Typical adhesive used to effect reel transfers is very thick and tacky. Examples of adhesive include National Starch 18-3369, National Starch 18-3372, H.B. Fuller WB 4985-S, Swift 19444 and Swift 47353. The adhesive melt units, if used, are warmed to approximately 150 to about 200 degrees Fahrenheit depending on the nature of the adhesive being heated. If more adhesive storage capacity is needed in addition to the storage capacity of the adhesive melt unit, the source of pressurized adhesive may also include additional adhesive storage units. The adhesive melting units are provided when it is necessary to reduce the viscosity of the adhesive in order to promote sprayability. As mentioned before, it should be appreciated that adhesives that are readily sprayable without heating or viscosity reduction would not require the associated heating of the various components of the adhesive supply unit or the melting unit. In any event, the adhesive is pumped from the source of pressurized adhesive through a supply hose and into the manifold system 30. Preferably, in order to maintain viscosity, the supply hoses that feed the adhesive from the source of pressurized adhesive or melt units to the manifold are heated. These hoses may be lined with Teflon® and may be wrapped with resistance wire and insulation. The supply hose again may have a temperature control by any means known in the art. Preferably, the temperature controller is disposed and contained integrally with the adhesive melt unit.

Next, adhesive of the appropriate viscosity to achieve sprayability is supplied to the manifold. When a first reel of tissue 12 is full, and in order to effect transfer of the moving tissue from the full reel to an empty reel being lowered into position 14, the valves are selectively activated and pressurized adhesive is dispensed through the nozzles and onto and across the width of the moving tissue web moving under the adhesive supply device. Before adhesive spraying occurs, the empty tissue take up reel 14 has been brought up to speed and into contact with the moving tissue web. When the segment of tissue having adhesive sprayed thereon reaches the rotating empty tissue take-up reel 14, the tissue web adheres to the new reel 14 and is torn substantially across its width and away from the first rotating tissue take up reel 12 thus completing the tissue take up process of the first tissue take up reel 12. The first tissue take up reel is then moved away and the empty reel 14 begins the tissue take up process. Because the adhesive is supplied substantially across the entire width of the tissue, the tissue with the adhesive sprayed thereon readily grips the empty reel resulting in substantially immediate transfer thereby minimizing waste and lost production. Air billows may be used to enhance the application of the tissue web to the empty reel.

What is claimed is:

1. A method of affecting the transfer of an advancing tissue web from one take-up reel to another in a winding unit of a paper machine utilizing a tissue transfer device comprising an adhesive source, at least one adhesive manifold, and a plurality of valves coupled to the adhesive source via the adhesive manifold, each of said valves in communication with a corresponding atomizing nozzle arranged across a widthwise dimension of said advancing web, said method comprising:

providing an adhesive in said adhesive source;

heating said adhesive in said tissue transfer device to at least about 150° F.;

pressurizing said adhesive in said tissue transfer device so as to supply adhesive to said valves at a pressure selected from a value between about 1000 psi and about 2500 psi;

accumulating a sufficient amount of said pressurized adhesive in at least one accumulator coupled to said manifold to reduce undesirable pressure drop from said adhesive source and said manifold so that adhesive may be supplied through said valves at said selected pressure over a duration of between about 100 ms and about 500 ms;

transferring said pressurized and heated adhesive to said plurality of valves to enable airless dispensing of said adhesive there from; and controlling said plurality of valves so as to dispense said adhesive from said atomizing nozzles across said widthwise dimension of said advancing web in an airless manner in intervals characterized by a duration between about 100 ms and about 500 ms.

2. A method as claimed in claim 1 wherein said adhesive is dispensed from said atomizing valves at an inclusive fan angle of between about 90 degrees and about 110 degrees.

3. A method as claimed in claim 1 wherein said adhesive manifold of said tissue transfer device comprises a heated manifold.

4. A method as claimed in claim 1 wherein said tissue transfer device comprises first and second heated manifolds.

5. A method as claimed in claim 1 wherein said pressurized and heated adhesive is transferred to said plurality of valves via a temperature-controlled feeder conduit extending from said manifold to each of said nozzles.

6. A method as claimed in claim 5 wherein a temperature of said feeder conduits is individually controlled.

7. A method as claimed in claim 1 wherein:

said tissue transfer device comprises at least two heated manifolds;

said pressurized and heated adhesive is transferred to said plurality of valves via a temperature-controlled feeder conduit extending from said manifold to each of said nozzles; and a temperature of said feeder conduits is individually controlled.

* * * * *